US005723272A

United States Patent [19]

Barber et al.

[11] Patent Number: 5,723,272

[45] Date of Patent: Mar. 3, 1998

[54] SILVER HALIDE LIGHT-SENSITIVE ELEMENT

[75] Inventors: Gary Norman Barber, Penfield; Margaret Jones Helber, Rochester, both of N.Y.

[73] Assignee: Eastman Kodak Company, Rochester, N.Y.

[21] Appl. No.: 572,904

[22] Filed: Dec. 22, 1995

[51] Int. Cl.[6] ..... G03C 1/06; G03C 1/815; G03C 1/825

[52] U.S. Cl. ..... 430/522; 430/510; 430/517; 430/511; 430/512; 430/554; 430/558; 430/523; 430/524; 430/525; 430/527; 430/531

[58] Field of Search ..... 430/510, 517, 430/522, 511, 512, 554, 558, 523, 524, 525, 527, 531

[56] References Cited

U.S. PATENT DOCUMENTS

| | | | |
|---|---|---|---|
| 4,203,769 | 5/1980 | Guestaux | 430/631 |
| 4,275,103 | 6/1981 | Tsubusaki et al. | 430/63 |
| 4,394,441 | 7/1983 | Kawaguchi et al. | 430/524 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/527 |
| 4,571,361 | 2/1986 | Kawaguchi et al. | 428/328 |
| 4,770,984 | 9/1988 | Ailliet et al. | 430/505 |
| 4,895,786 | 1/1990 | Kurematsu et al. | 430/522 |
| 4,956,269 | 9/1990 | Ikeda et al. | 430/522 |
| 4,999,276 | 3/1991 | Kuwabara et al. | 430/264 |
| 5,006,451 | 4/1991 | Anderson et al. | 430/527 |
| 5,122,445 | 6/1992 | Ishigaki | 430/523 |
| 5,213,956 | 5/1993 | Diehl et al. | 430/522 |
| 5,221,598 | 6/1993 | Anderson et al. | 430/527 |
| 5,326,686 | 7/1994 | Katoh et al. | 430/522 |
| 5,346,810 | 9/1994 | Ohno | 430/522 |
| 5,368,995 | 11/1994 | Christian et al. | 430/530 |
| 5,399,690 | 3/1995 | Diehl et al. | 544/301 |
| 5,451,494 | 9/1995 | Diehl et al. | 430/522 |

FOREIGN PATENT DOCUMENTS

| | | |
|---|---|---|
| 252550 | 1/1988 | European Pat. Off. . |
| 397435 | 11/1990 | European Pat. Off. . |
| 582000 | 2/1994 | European Pat. Off. . |
| 675403 | 4/1995 | European Pat. Off. . |
| 63-023151 | 7/1986 | Japan . |
| 2-103538 | 10/1988 | Japan . |
| 5-027348 | 7/1991 | Japan . |
| 1540543 | 2/1979 | United Kingdom . |

*Primary Examiner*—Geraldine Letscher
*Attorney, Agent, or Firm*—Andrew J. Anderson

[57] ABSTRACT

Silver halide light sensitive photographic elements comprising a support bearing on one side thereof at least one blue-sensitive silver halide emulsion yellow-image forming layer, at least one red-sensitive silver halide emulsion cyan-image forming layer, at least one green-sensitive silver halide emulsion magenta-image forming layer, and an anti-halation layer comprising a cyan filter dye coated between the support and the red-sensitive layer, wherein the green-sensitive layer comprises a four equivalent magenta image forming coupler and the cyan filter dye is of the formula (I):

(I)

where $L^1$, $L^2$, $L^3$, $L^4$ and $L^5$ are methine groups; $R^1$, $R^2$, $R^3$ and $R^4$ are independently H or alkyl or aryl groups; and $M^+$ is H or a counter ion; wherein at least one of $R^1$, $R^2$, $R^3$ and $R^4$ comprises an aryl group substituted with a substituent having a $\pi$ value of less than −0.10, where $\pi$ represents the group substituent component of the hydrophobicity parameter logP. In a preferred embodiment of the invention, $R^3$ and $R^4$ are each H, and $R^1$ and $R^2$ are each phenyl groups substituted with one or more substituents, where the sum of the $\pi$ values for the substituents on each of the $R^1$ and $R^2$ phenyl groups is less than −0.10 at pH above 8. Photographic elements in accordance with the invention exhibit reduced dye stain after photographic processing, resulting in lower red minimum densities. Such elements also exhibit higher maximum densities, upper scale contrasts, and relative speeds compared to prior art materials. Elements in accordance with preferred embodiments of the invention exhibit improved safelight performance.

20 Claims, No Drawings

SILVER HALIDE LIGHT-SENSITIVE ELEMENT

TECHNICAL FIELD

This invention relates generally to the field of silver halide light sensitive elements, and in particular to such elements comprising a dye antihalation layer. In a particular aspect it relates to motion picture print films.

BACKGROUND OF THE INVENTION

The photographic industry has long recognized the need to provide photographic elements with some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby reexposed at locations different from the original light path through the emulsion, resulting in "halos" on the film surrounding images of bright objects.

One method proposed for antihalation protection in photographic films comprises providing a dyed or pigmented layer behind a clear support as an antihalation backing layer, wherein the backing layer is designed to be removed during processing of the film. Typical examples of such antihalation backing layers comprise a light absorbing dye or pigment (such as carbon black) dispersed in an alkali-soluble polymeric binder (such as cellulose acetate hexahydrophthalate) that renders the layer removable by an alkaline photographic processing solution. Such carbon containing "rem-jet" backing layers have been commonly used for antihalation protection in motion picture films. The carbon particles additionally provide antistatic protection prior to being removed. While such rem-jet backing layers provide effective antihalation and antistatic protection for photographic films prior to processing, their use requires special additional processing steps for their subsequent removal, and incomplete removal of the carbon particles can cause image defects in the resulting print film. Additionally, it is often desirable to provide "process surviving" antistatic protection for photographic elements in order to prevent static build-up even after imagewise exposure and processing, especially for motion picture films which are subject to rapid transport through projection apparatus where static charges can attract dust particles which may detrimentally impact a projected image.

Accordingly, alternatives for carbon-containing, process-removable, antihalation/antistatic backing layers for photographic materials are desirable. One such alternative is to use antihalation undercoat layers containing filter dyes coated between the support and the emulsion layers wherein the filter dyes are solubilized and removed and/or decolorized during processing of the film, and a separate process-surviving antistatic backing layer. Dyes may be selected and used in combinations to provide antihalation protection throughout the visible spectrum. Process-surviving antistatic layers typically include, e.g., ionic polymers, electronic conducting non-ionic polymers, and metal halides or metal oxides in polymeric binders. Conductive fine particles of crystalline metal oxides dispersed with a polymeric binder have been found to be especially desirable for preparing optically transparent, humidity insensitive, antistatic layers for various imaging applications.

U.S. Pat. No. 4,770,984 discloses the use of barbituric acid oxonol filter dyes of formula (A) in color photographic elements:

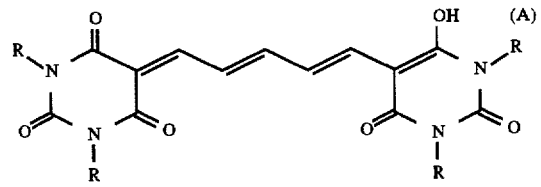

in which each of the R substituents independently represent hydrogen or substituted or unsubstituted alkyl, alkoxy, or aryl groups. Such dyes have been found to be effective absorbers of red-light, and accordingly provide antihalation protection for red-light sensitive layers when incorporated in a layer between the red-light sensitive layer and the support of a photographic element. When used in combination with additional filter dyes contained in the same or other antihalation layers between the support and a light sensitive layer, such as yellow colored, blue-light absorbing filter dyes, antihalation protection across the visible region may be achieved.

PROBLEMS TO BE SOLVED

One problem associated with many antihalation filter dyes incorporated into photographic elements is the undesirable interaction of the dyes with other components in the photographic system. Dyes may interact with other photographic components either before or during processing, such as with photographic couplers or with oxidized developer. Such interactions can alter the desired photographic activity of the dyes or couplers, and in some cases generate by-products resulting in deleterious stains in the element. It has been found, e.g., that use of many of the dyes of above formula (A) results in undesirable dye stain when used in combination with four-equivalent magenta couplers in photographic elements. It has also been found that many of such dyes interact with other photographic components to cause lower maximum densities, contrasts, and relative speeds in photographic elements containing such dyes. It has further been found that many of such dyes do not provide adequate safelight protection for common safelights emitting in the range of 560–630 nm, such as those using a Kodak Safelight Filter No. 8.

SUMMARY OF THE INVENTION

It is an object of the invention to provide photographic elements comprising barbituric acid oxonol antihalation filter dyes which leave little or no deleterious stains in the element as a result of interaction with other components of the photographic element. It is a further object to provide photographic elements comprising such filter dyes which are non-wandering, which are fully removed and/or decolorized upon photographic processing, and which do not adversely interact with other photographic components to cause lower maximum densities, contrasts and relative speeds in such photographic elements. It is a further object to provide effective safelight protection in photographic elements when using such dyes.

These and other objects are achieved in accordance with the invention, one embodiment of which comprises a silver halide light sensitive photographic element comprising a support bearing on one side thereof at least one blue-sensitive silver halide emulsion yellow-image forming layer, at least one red-sensitive silver halide emulsion cyan-image forming layer, at least one green-sensitive silver halide emulsion magenta-image forming layer, and an antihalation layer comprising a cyan filter dye coated between the support and the red-sensitive layer, wherein the green-sensitive layer comprises a four-equivalent magenta image forming coupler and the cyan filter dye is of the formula (I):

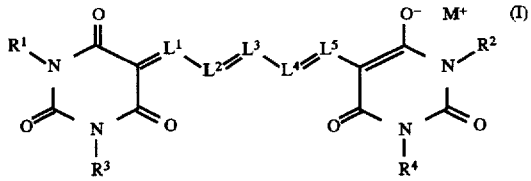

(I)

where $L^1$, $L^2$, $L^3$, $L^4$ and $L^5$ are methine groups;

$R^1$, $R^2$, $R^3$ and $R^4$ are independently H or alkyl or aryl groups; and $M^+$ is H or a counter ion;

wherein at least one of $R^1$, $R^2$, $R^3$ and $R^4$ comprises an aryl group substituted with a substituent having a $\pi$ value of less than −0.10, where $\pi$ represents the group substituent component of the hydrophobicity parameter logP as further defined below.

In a preferred embodiment of the invention, $R^3$ and $R^4$ are each H, and $R^1$ and $R^2$ are each phenyl groups substituted with one or more substituents, where the sum of the $\pi$ values for the substituents on each of the $R^1$ and $R^2$ phenyl groups is less than −0.10 at pH above 8.

ADVANTAGES

Photographic elements in accordance with the invention exhibit reduced dye stain after photographic processing, resulting in lower red minimum densities. Such elements also exhibit higher maximum densities, upper scale contrasts, and relative speeds compared to prior art materials. Elements in accordance with preferred embodiments of the invention exhibit improved safelight performance.

DETAILED DESCRIPTION

Photographic elements of the invention can be black-and-white or single color elements, but preferably are multicolor elements. Multicolor elements typically contain image dye-forming units sensitive to each of the three primary regions of the visible spectrum, i.e. blue about 400 to 500 nm), green (about 500 to 600 nm), and red (about 600 to 760 nm) sensitive image dye-forming units. Each unit can comprise a single emulsion layer or multiple emulsion layers sensitive to a given region of the spectrum. The layers of the element, including the layers of the image-forming units, can be arranged in various orders as known in the art. The invention is particularly applicable to photographic print elements designed for exposure though a negative film and projection display, such as motion picture print and intermediate films.

Photographic elements of the invention comprise an antihalation layer comprising process removable or decolorizable barbituric acid oxonol filter dyes of formula (I) located between a red-light sensitive layer of the element and the element support. Depending upon the layer arrangement and sensitivities of the various layers of the element, additional antihalation filter dyes may be incorporated in the same antihalation layer as the barbituric acid oxonol dye, and/or may be incorporated into separate antihalation layers. For example, where the element comprises a support bearing in order separate blue-sensitive, red-sensitive, and green-sensitive silver halide layers coated thereon (which is a preferred arrangement for motion picture color print films), a yellow-colored, blue-light absorbing antihalation layer may be coated between the support and the blue-sensitive layer, and the red-light absorbing barbituric acid oxonol dye containing layer may be coated between the blue-sensitive layer and the red-sensitive layer. In preferred embodiments of the invention, however, the barbituric acid oxonol dye as well as additional antihalation dyes are incorporated in an antihalation layer coated between the support and all silver halide emulsion layers thereon.

In formula (I), $L^1$–$L^5$ are methine groups. For the purpose of this invention, the term methine group is intended to describe substituted or unsubstituted methine linking units. Preferable substituents for the methine groups are alkyl groups of 1 to 6 carbon atoms such as methyl, ethyl, butyl, etc. $R^1$–$R^4$ may be aliphatic groups (e.g., linear or cyclic alkyl groups having from 1 to 6 carbon atoms, such as methyl, propyl, butyl, cyclohexyl, etc.), aryl groups (e.g., phenyl, naphthyl, etc.), or H. Similarly, such $R^1$–$R^4$ groups are intended to define unsubstituted or further substituted groups. $M^+$ is H or a cationic counter ion, such as Na, K, pyridinium, triethylammonium, ammonium, etc.

In accordance with the invention, at least one R1–$R^4$ substituent of the barbituric acid oxonol dyes of formula (I) is an aryl group functionalized with one or more substituents having a $\pi$ value less than −0.10, where $\pi$ represents the group substituent component of the hydrophobicity parameter log P, and is defined for the purposes of this invention as follows:

$$\pi(x)=\log P(C_6H_5-x)-\log P(C_6H_6)$$

where log $P(C_6H_5-x)$ is the log partition coefficient of benzene substituted with substituent x and log $P(C_6H_6)$ is the log partition coefficient of benzene. The log P parameter is a well-known measurement of the solubility of a compound in aqueous liquids compared to its solubility in a nonpolar organic solvent (octanol). The log P parameter, and $\pi$ substituent component, are further described, along with data for various compounds and substituents, in C. Hansch & T. Fujita, J. Am. Chem. Soc., 86, 1616–25 (1964) and A. Leo & C. Hansch, *Substituent Constants for Correlation Analysis in Chemistry and Biology*, Wiley, N.Y. (1979), the disclosures of which are incorporated herein by reference.

Preferred low $\pi$ value substituents include but are not restricted to ionizable groups (e.g. a carboxyl group, a sulfonamido group, a sulfamoyl group, a sulfonylcarbamoyl group, a carbonylsulfamoyl group, a hydroxy group, etc.), amide groups, acetyl, cyano, and sulfonamide groups. Ionizable group substituents preferably have a dissociation constant pKa between 2–10 as measured in 50/50 (volume basis) mixtures of ethanol and water, where pKa is a well-known measurement of the dissociation constant of an ionizable compound in aqueous environments. Techniques for determining the pKa of a compound in ethanol and water are well-known in the art and many reference texts present such pKa data in tabular form. Dyes in accordance with the invention leave little or no stain as a result of interaction with 4-equivalent magenta couplers incorporated within the same photographic element.

The $L^1$–$L^5$ methine and $R^1$–$R^4$ alkyl and aryl groups of formula (I) may be further substituted with one or more photographically acceptable substitutents selected from an alkyl group, an aryl group, a hetercyclic group, an alkoxyl group (for example, methoxy, 2-methoxyethoxy), an aryloxy group (for example, 2,4-di-tert-amyl phenoxy, 2-chlorophenoxy, 4-cyanophenoxy), an alkenyloxy group (for example, 2-propenyloxy), an acyl group (for example, acetyl, benzoyl), an ester group (for example, butoxycarbonyl, phenoxycarbonyl, acetoxy, benzoyloxy, butoxysulfonyl, toluenesulfonyloxy), an amido group (for example, acetylamino, methanesulfonamido, dipropylsulfamoylamino), a carbamoyl group (for example, dimethylcarbamoyl, ethylcarbamoyl), a sulfamoyl group (for example, butylsulfamoyl), an imido group (for example, succinimido, hydantoinyl), a ureido group (for example, phenylureido, dimethylureido), an aliphatic or aromatic sulfonyl group (for example, methanesulfonyl, phenylsulfonyl), an aliphatic or aromatic thio group (for example, ethylthio, phenylthio), a hydroxy group, a cyano group, a carboxy group, a nitro group, a sulfo group, and a halogen atom.

In a preferred embodiment of the invention, $R^3$ and $R^4$ are each H, and $R^1$ and $R^2$ are each phenyl groups substituted with one or more substituents, where the sum of the $\pi$ values for the substituents on each of the $R^1$ and $R^2$ phenyl groups is less than −0.10 at pH above 8. For ionizable substituents, the $\pi$ value in such calculation is taken as that of the predominant form of such substituent at such pH.

Exemplary dyes of formula (I) include the following:

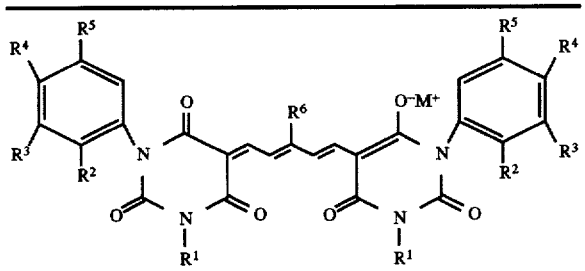

| Dye | $R^1$ | $R^2$ | $R^3$ | $R^4$ | $R^5$ | $R^6$ | M+ |
|---|---|---|---|---|---|---|---|
| I-1 | H | H | H | OH | H | H | *TEAH |
| I-2 | H | H | H | $CONH_2$ | H | H | $NH_4$ |
| I-3 | H | H | H | COOH | H | H | H |
| I-4 | H | H | Cl | OH | Cl | H | $C_5H_6N$ |
| 5 | H | H | OH | H | H | H | H |
| 6 | H | H | H | $NHSO_2CH_3$ | H | H | H |
| 7 | H | OH | H | H | H | H | H |
| 8 | H | H | OH | $CH_3$ | H | H | H |
| 9 | H | H | COOH | H | H | H | TEAH |
| 10 | H | H | $CONH_2$ | H | H | H | TEAH |
| 11 | H | H | H | $SO_2NH_2$ | H | H | H |
| 12 | H | H | OH | H | OH | H | H |
| 13 | H | H | OH | OH | H | H | H |
| 14 | H | H | $NHSO_2Et$ | H | H | H | $C_5H_6N$ |
| 15 | H | H | H | OH | H | Me | H |
| 16 | H | H | H | OH | H | Et | TEAH |
| 17 | H | H | H | COOH | H | Me | H |
| 18 | H | H | OH | COOH | H | H | TEAH |
| 19 | H | H | H | $NHSO_2CH_3$ | H | Me | H |
| 20 | H | H | OH | H | OH | Me | H |
| 21 | H | H | CN | H | H | H | H |
| 22 | H | H | H | $NHCH_3$ | H | H | H |
| 23 | H | H | H | $NHCOCH_3$ | H | H | Na |
| 24 | H | $COCH_3$ | H | H | H | H | Me |
| 25 | H | H | H | NHOH | H | H | TEAH |
| 26 | H | H | $CONHCH_3$ | H | H | H | $C_5H_6N$ |
| 27 | H | H | $NHCONH_2$ | H | H | Et | TEAH |
| 28 | H | H | H | CONHOH | H | H | H |
| 29 | H | H | H | $NH_2$ | H | H | H |
| 30 | H | H | $SO_2CH_3$ | H | H | H | H |

*TEAH is triethylammonium

In addition to the barbituric acid oxonol filter dyes described above, additional filter dyes may be included in the same or separate antihalation layers in accordance with preferred embodiments of the invention. Both the barbituric filter dyes of the invention and any additional antihalation filter dyes are preferably incorporated into the photographic element in the form of solid particle dispersions which are readily solublized and removed or decolorized upon photographic processing.

Preferred filter dyes that can be used in combination with the barbituric acid oxonol filter dyes described above in the form of solid particle dispersions include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D—(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxanol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$$[D—(A)_y]—X_n$$

where D, X and n are as defined above, and A is an aromatic ring bonded directly or indirectly to D, y is 0 to 4, and X is bonded either on A or an aromatic ring portion of D.

Exemplary dyes of the above formulas include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above.

It is especially preferable to include a yellow-colored, blue-light absorbing filter dye in an antihalation layer in combination with use of the barbituric acid oxonol filter dyes of the invention. Exemplary blue-light absorbing dyes include the merostyryl dyes of formula (I) and monomethine oxonol dyes of formula (II) of U.S. Pat. No. 4,770,984 referenced above, the disclosure of which is hereby incorporated by reference. Additional preferred yellow dyes include yellow arylidene dyes of the above referenced solid particle dye patents.

In a further preferred embodiment of the invention, the barbituric acid oxonol filter dyes of formula I are also used in combination with tricyanopropene filter dyes of the formula (II):

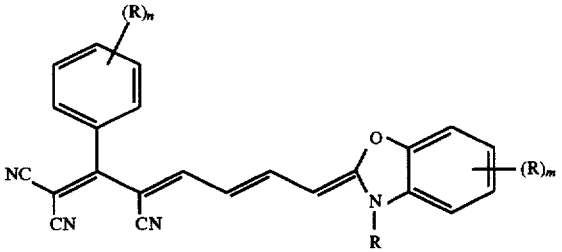

(II)

wherein each R represents H or a substituent, n represents 0–5, and m represents 0–4. Examples of R substituents include halogen, cyano, hydroxy, and substituted or unsubstituted alkyl, aryl, alkoxy, aryloxy, amino, alkoxycarbonyl, amido, acyl, alkylamino, carboxy, sulfonamido, and sulfamoyl groups. Examples of alkyl groups include methyl, ethyl, n-propyl, n-hexyl or isohexyl. Examples of substituted alkyl groups include, e.g., methoxyethyl, hydroxymethyl, etc. Examples of alkoxy groups include, e.g., methoxy, ethoxy, butoxy. Examples of aryl groups include phenyl, naphthyl, anthracenyl, pyridyl and styryl. Examples of substituted aryl groups include, e.g., tolyl, m-chlorophenyl, p-methanesulfonylphenyl, etc. Preferably such dyes contain a group having an ionizable proton in accordance with the filter dye formula D—$(X)_n$ defined above so that they may be incorporated in the form of solid particle dispersions which are readily solubilized and removed or decolorized upon photographic processing.

Combinations of filter dyes of formulas (I) and (II) of the instant invention have been found to provide beneficial properties in terms of combined antihalation protection and safelight protection performance in the 560–630 nm range. Exemplary tricyanopropene filter dyes of formula (II) in accordance with such preferred embodiment include the following dyes:

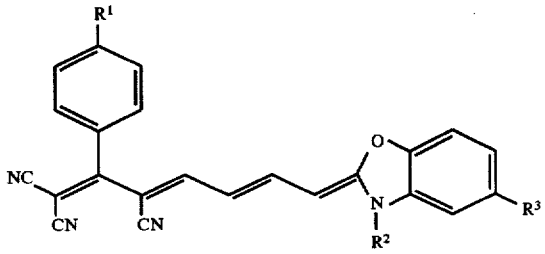

| Dye | $R^1$ | $R^2$ | $R^3$ |
|---|---|---|---|
| II-1 | $NHSO_2CH_3$ | $CH_3$ | $NHSO_2CH_3$ |
| II-2 | COOH | $CH_3$ | COOH |
| II-3 | $NHSO_2CH_3$ | $CH_3$ | COOH |
| II-4 | COOH | $CH_3$ | $NHSO_2CH_3$ |
| II-5 | $NHSO_2CH_3$ | $CH_2CH_3$ | H |
| II-6 | COOH | $CH_2CH_3$ | H |
| II-7 | H | $CH_3$ | COOH |
| II-8 | H | $CH_3$ | $NHSO_2CH_3$ |
| II-9 | COOH | 4-carboxy benzyl | H |
| II-10 | $NHSO_2CH_3$ | 4-carboxy benzyl | H |

In preferred embodiments of the invention, the antihalation layer is a hydrophilic colloid layer. The hydrophilic colloid is preferably gelatin. This may be any gelatin or modified gelatin such as acetylated gelatin, phthalated gelatin, oxidized gelatin, etc. Gelatin may be base-processed, such as lime-processed gelatin, or may be acid-processed, such as acid-processed ossein gelatin. The hydrophilic colloid may be another water-soluble polymer or copolymer or mixtures thereof with gelatin, including, but not limited to, poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

For effective safelight and antihalation protection, antihalation filter dyes are preferably incorporated into the antihalation layers of the invention at coverages to provide optical densities of from about 0.3 to 1.5 across the visible spectrum. In accordance with a preferred embodiment of the invention, antihaltion dyes are incorporated to provide optical densities of from 0.3–1.0 in the blue and red regions, and from 0.5–1.5 in the green region prior to processing and removal. For optimized safelight and antihalation protection, in preferred embodiments of the invention, a blue light absorbing (yellow colored) merostyryl, monomethine oxonol and/or arylidene filter dye is used at a combined coverage of from about 10–500 mg/m$^2$ (more preferably 25–100 mg/m$^2$), a red light absorbing dye of formula I is used at coverage from about 10–500 mg/m$^2$ (more preferably 25–100 mg/m$^2$), and a dye of formula II is used at coverage from about 10 to 500 mg/m$^2$ (more preferably 50–200 mg/m$^2$).

The invention is particularly useful with color photographic print elements. In color photographic element printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure*, December, 1987, item 17643, published by Industrial Opportunities Ltd., Homewell Havant, Hampshire, P09 1EF, United Kingdom, and *Research Disclosure*, September 1994, Item 36544, published by Kenneth Mason Publications, Ltd., Emsworth, Hampshire P010 7DQ, England. Materials in which such images are formed can be exposed to an original scene in a camera, or can be duplicates formed from such camera origination materials, such as records formed in color negative intermediate films such as those identified by the tradenames Eastman Color intermediate Films 2244, 5244 and 7244. Alternatively, the original record may be in the form of electronic image data, which may be used to control a printer apparatus, such as a laser printer, for selective imagewise exposure of a print film in accordance with the invention.

The photographic element of the invention preferably comprises a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion layers sensitized to the red, green and blue regions of the spectrum. Such materials are described in the Research Disclosure publications cited above. It is within the scope of this invention for the light sensitive material to also be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Diffusible couplers are used in color developer solutions. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described by Edwards et al. in International Publication No. WO 93/012465.

In the following discussion of suitable materials for use in the emulsions and elements that can be used in conjunction with the invention, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure*, February 1995, Item 37038 also may be advantageously used with elements of the invention.

Photographic light-sensitive materials of the invention may utilize silver halide emulsion image forming layers wherein chloride, bromide and iodide are present as a mixture or combination of at least two halides. The combinations significantly influence the performance characteristics of the silver halide emulsion. As explained in Atwell, U.S. Pat. No. 4,269,927, silver halide with a high chloride content possesses a number of highly advantageous characteristics. For example, high chloride silver halides are more soluble than high bromide silver halides, thereby permitting development to be achieved in shorter times. Furthermore, the release of chloride into the developing solution has less restraining action on development compared to bromide and this allows developing solutions to be utilized in a manner that reduces the amount of waste developing solution.

Couplers that may be used in the elements of the invention can be defined as being 4-equivalent or 2-equivalent depending on the the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, heterooxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published application Nos. 1,466,728; 1,531,927; 1,533,039; 2,006,755A and 2,017,704A, the disclosures of which are incorporated herein by reference.

In accordance with the photographic elements of the invention, the green-sensitive layer comprises a four-equivalent magenta coupler, either alone or in combination with other four- or two-equivalent couplers. Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Typical pyrazoloazole and pyrazolone couplers are represented by the following formulas:

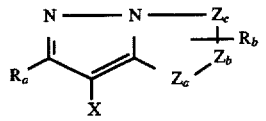

MAGENTA-1

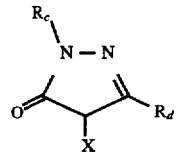

MAGENTA-2 wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =CH—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$. Preferably, a ballast group is incorporated in either $R_a$ or $R_b$ in MAGENTA-1 and in either $R_c$ or $R_d$ in MAGENTA-2.

In accordance with the invention, four-equivalent magenta couplers include those of formulas MAGENTA-1 and MAGENTA-2 above where X represents hydrogen.

Couplers that form cyan dyes upon reaction with oxidized color developing agents which may be included in elements of the invention include those which are described in such representative patents and publications as: U.S. Pat. Nos.

2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

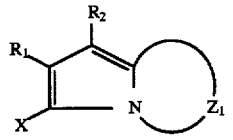

CYAN-2

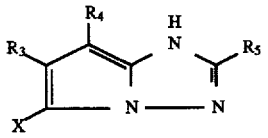

CYAN-3

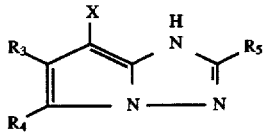

CYAN-4

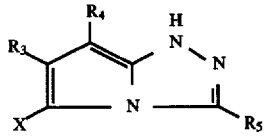

CYAN-5

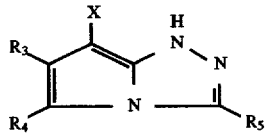

CYAN-6

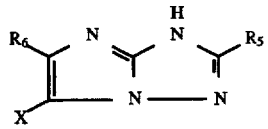

wherein $R_1$ and $R_5$ each represent a hydrogen or a substituent; $R_2$ represents a substituent; $R_3$ and R4 each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —NH—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

More preferable are cyan couplers of the following formulas:

CYAN-7

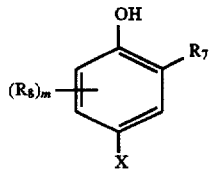

CYAN-8

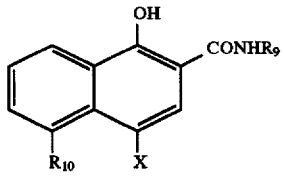

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

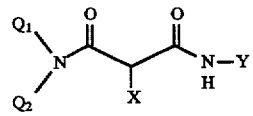

YELLOW-2

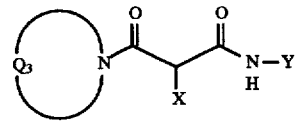

YELLOW-3

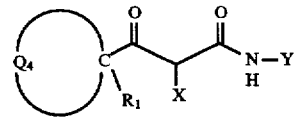

YELLOW-4

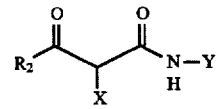

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

To control the migration of various components coated in a photographic layer, including couplers, it is preferable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

Typical examples of photographic substituents include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

It may be useful to use a combination of couplers any of which may contain known ballasts or coupling-off groups such as those described in U.S. Pat. Nos. 4,301,235; 4,853,319 and 4,351,897.

If desired, the photographic elements of the invention can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND.

The photographic elements of the invention preferably additionally comprise an antistatic layer coated on the opposite side of the element support relative to the element's light sensitive image forming layers. The antistatic layer is preferably transparent and process surviving, and may include a protective overcoat layer to provide abrasion resistance and/or enhanced frictional characteristics. Any antistatic materials such as those previously suggested for use with photographic elements may be used in the antistatic layer. Such materials include, e.g., ionic polymers, electronic conducting non-ionic polymers, and metal halides or metal oxides in polymer binders. Conductive fine particles of crystalline metal oxides dispersed with a polymeric binder have been used to prepare optically transparent, humidity insensitive, antistatic layers for various imaging applications. Many different metal oxides, such as AnO, $TiO_2$, $ZrO_2$, $Al_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445, the disclosures of which are hereby incorporated by reference. Preferred metal oxides include antimony-doped tin oxide and vanadium pentoxide which have been found to provide acceptable performance characteristics in demanding environments.

Preferred binders which may be included in the antistatic layer of the photographic elements of the invention include vinylidene chloride-containing polymer latexes and polyesterionomer dispersions, which can improve the integrety of the antistatic layer and the adhesion of the layer to the support. Polyesterionomers refers to polyesters that contain at least one ionic moiety. Such ionic moieties function to make the polymer water dispersable. These polymers are prepared by reacting one or more dicarboxylic acids or their functional equivalents such as anhydrides, diesters, or diacid halides with one or more diols in melt-phase polycondensation reactions well known in the art as shown in U.S. Pat. Nos. 3,018,272; 3,929,489; 4,307,174 and 4,419,437. Examples of this class of polymers include, for example, Eastman™ AQ polyesterionomers manufactured by Eastman Chemical Company.

To provide protection of the antistatic layer in the elements of the invention, a protective overcoat may be applied thereon. The protective layer can chemically isolate the antistatic layer and also serve to provide scratch and abrasion resistance. The protective overcoat layers may be, e.g., cellulose esters, cellulose nitrate, polyesters, acrylic and methacrylic copolymers and homopolymers, polycarbonates, polyvinyl formal, polymethyl methacrylate, polysilicic acid, polyvinyl alcohol, and polyurethanes. Such layers may be aqueous coated or organic solvent coated as appropriate. The antistatic layer may also be overcoated with a barrier layer comprising a latex polymer having hydrophilic functionality as disclosed in U.S. Pat. No. 5,006,451 if desired. Such barrier layers provide excellent adhesion between vanadium pentoxide antistatic layers and overlying layers. A protective topcoat may also be preferably used as described in copending, commonly assigned U.S. Ser. No. 08/576,796, filed Dec. 21, 1995 corresponding to Provisionally filed U.S. Ser. No.60/006179 (Kodak Docket No. 73068APL), filed Nov. 2, 1995, the disclosure of which is incorporated by reference herein, which comprises a polyurethane binder and a lubricant, where the polyurethane binder has a tensile elongation to break of at least 50% and a Young's modulus measured at 2% elongation of at least 50,000 $lb/in^2$.

The chemical resistance of the antistatic layer or an overcoat can be improved by incorporating a polymer cross-linking agent into the antistatic layer or those overcoats that have functionally cross-linkable groups. Cross-linking agents such as aziridines, carbodiimide, epoxys, and the like are suitable for this purpose.

A suitable lubricant may also be included in the antistatic layer or protective overcoat in order to provide desired friction performance to assure good transport characteristics during manufacturing and handling of the elements of the invention. Many lubricating agents can be used including higher alcohol esters of fatty acids, higher fatty acid calcium salts, metal stearates, silicone compounds, paraffins and the like. Suitable lubricants include silicone oil, silicones having polar groups, fatty acid-modified silicones, fluorine-containing silicones, fluorine-containing alcohols, fluorine-containing esters, polyolefins, polyglycols, alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), alkoxy alcohols having 12 to 22 carbon atoms, mono-, di- and tri-esters of monobasic fatty acids having 10 to 24 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoakyl ethers of alkylene oxide polymers, fatty acid amides having 8 to 22 carbon atoms and aliphatic amines having 8 to 22 carbon atoms. Specific examples of these compounds (i.e., alcohols, acids or esters) include lauric acid, myristic acid, palmitic acid, stearic acid, behenic acid, butyl stearate, oleic acid, linolic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Aqueous dispersed lubricants are preferred as they may be directly incorporated into an aqueous antistatic or overcoat layer, thus avoiding the need for a separately applied lubricant layer. The aqueous dispersed lubricants of carnauba wax and stearates are preferred for their effectiveness in controlling friction at low lubricant levels and their excellent compatibility with aqueous overcoat polymer solutions.

Matting agents may also be included in the antistatic layer or overcoat thereon in order to improve transport properties of the elements of the invention on manufacturing, printing, processing, and projecting equipment. Such matting agents can also help prevent sticking between the front and back sides of the elements in a tightly wound roll. Matting agents may be, e.g., silica, calcium carbonate, other mineral oxides, glass spheres, ground polymers and high melting point waxes, and polymeric matte beads.

The antistatic layer may also contain a coating aid to improve coatability, including anionic or nonionic coating aids such as para-isononylphenoxyglycidol ethers, octylphenoxy polyethoxy ethanol, sodium salts of alkylaryl polyether sulfonates, and dioctyl esters of sodium sulfosuccinic acid. Such coating aids are typically used at from 0.01 to 0.30 weight percent based on the total coating solution weight.

It is further preferable to include a palladium compound in the photographic elements of the invention, especially where an antistatic layer comprising vanadium pentoxide is used as described in commonly assigned, concurrently filed U.S. patent application Ser. No. 08/577,757, filed Dec. 22, 1995 (Kodak Docket No. 73238AJA), the disclosure of which is incorporated by reference. Such palladium compounds may be incorporated at any location of the element, but are preferably present in silver halide emulsion layers or hydrophilic layers adjacent thereto. The palladium compound can be a salt of palladium, a complex salt of palladium, or a neutral complex of palladium. Examples of palladium salts include potassium tetrachloropalladate(II), ammonium tetrachloropalladate(II), potassium hexachloropalladate(IV). More preferable are complexes of amines with palladium, such as bis(1,2-ethane diamine-N, N')palladium(2+) dichloride and complexes of palladium with glycine. The complexes of amines with palladium may either be prepared, isolated, and then added to a layer coating composition, or more preferably created in-situ by treating a solution of potassium tetrachloropalladate(II) with the complexing agent, followed by addition to a coating solution. The palladium compound is preferably incorporated into a photographic element layer at levels of 0.1 to 100 mg/m$^2$ of palladium, more preferably 0.1 to 20 mg/m$^2$ of palladium.

Preferred supports for elements in accordance with the invention comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate). In addition to the specific components and layers described above, the photographic elements of the invention may include further features and layers as are known in the art. Polyester supports, e.g., typically employ undercoat or primer layers to improve adhesion of other layers thereto. Such undercoat layers are well known in the art and comprise, e.g., a vinylidene chloride/methyl acrylate/itaconic acid terpolymer or vinyldene chloride/acrylonitrile/acrylic acid terpolymer as described in U.S. Pat. Nos. 2,627,088; 2,698,235; 2,698,240; 2,943,937; 3,143,421; 3,201,249; 3,271,178; 3,501,301.

As described above, the filter dyes used in the antihalation layer are preferably designed to be solubilized and removed or decolorized during photographic processing. Conventional processing of photographic print elements include the Kodak ECP-2B Process for motion picture print films, described in Kodak Publication No. H-24, Manual For Processing Eastman Color Films, the disclosure of which is hereby incorporated by reference.

Incorporation of process removable or decolorizable filter dye containing antihalation layers in accordance with the invention eliminates the need for other means of antihalation and backside safelight protection. In a preferred embodiment of the invention, the use of a filter dye containing antihalation layer in place of a carbon containing "rem-jet" antihalation layer provides photographic element processing simplification advantages, allowing for the removal of several currently practiced conventional process steps required for rem-jet removal, such as the prebath and wash steps conventionally performed prior to the development step during processing of rem-jet containing films. Removing these steps is a great environmental advantage in the processing of photographic elements which have previously used rem-jet backing layers such as motion picture films, due to the large water and chemical savings. These modifications simplify the processing steps considerably yielding various economic and environmental advantages.

The following examples illustrate the preparation of photographic elements in accordance with this invention.

EXAMPLE 1

A dispersion of control filter dye A-1 was made by placing 5.0 g of dye A-1 in an 8 oz glass jar containing 4.0 g of a 10% aqueous solution of polyvinylpyrrolidone (Luviskol™ K30), 3.0 g of a 10% solution of Triton™ X-200 surfactant, 38.0 g of distilled water and 125 ml of 1.8 mm zirconium oxide beads. The mixture was milled for 3 days with a SWECO™ vibratory mill. The dispersion was diluted with distilled water and separated from the milling beads to yield a 4.71% dye dispersion (dispersion A). This dispersion was then mixed with deionized gelatin, water, and spreading aids, and then coated on a gelatin subbed polyethylene terephthlate support with rem-jet carbon black backing in a magenta monochrome format with the following structure (element A):

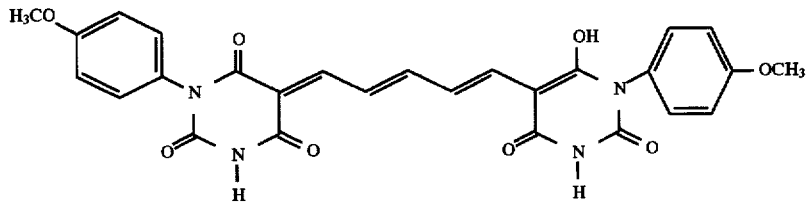

Dye A-1

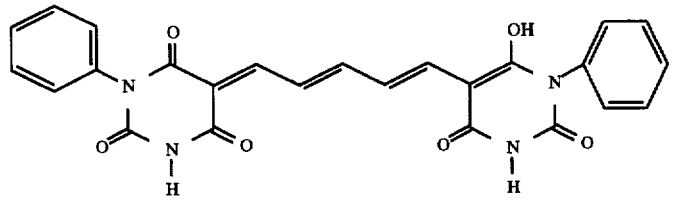

Dye A-2

Element A

Protective Overcoat Layer

Poly(dimethyl siloxane) 200-CS, 65.9 mg/m$^2$

Poly(methyl methacrylate) beads, 5.0 mg/m$^2$

Soluble green filter dye 1, 32.3 mg/m$^2$

Soluble green filter dye 2, 32.3 mg/m$^2$

Gelatin, 977.4 mg/m$^2$

Spreading aids

Gelatin hardener

Green Sensitized Layer

AgClBr cubic grain emulsion, 25% Br, 0.15 micron, sensitized with green dye cpd 1, 0.5273 mmole/Ag mole, supersensitizer cpd 2, 1.1212 mmole/Ag mole, 470.4 mg/m$^2$ AgClBr cubic grain emulsion, 25% Br, 0.24 micron, sensitized with green dye cpd 1, 0.4785 mmole/Ag mole, supersensitizer cpd 2, 1.3902 mmole/Ag mole, 40.9 mg/m$^2$ Magenta dye forming coupler (M-1), 678.1 mg/m$^2$ Oxidized developer scavenger, cpd 3, 53.8 mg/m$^2$ Gelatin, 1916 mg/m$^2$ Spreading aids Antihalation Layer Filter dye A-1 (control), 75.3 mg/m$^2$ Deionized gelatin, 1076 mg/m$^2$ Spreading aids Support Transparent polyethylene terephthalate support with rem-jet carbon black pigmented, nongelatin layer on the back of the film base which provides antihalation and antistatic properties In a similar manner, control filter dye A-2 and invention dyes I-1, I-2, I-3, and I-4 were milled to yield dye dispersions B, C, D, E, and F, respectively, and then coated in an identical monochrome format (elements B-F, respectively). An additional monochrome (element G) was prepared in which no filter dye was present in the antihalation layer. Structures of the dyes in accordance with the invention are indicated above. Structures of comparative dyes A-1 and A-2 are illustrated below. Structures of additional compounds identified in the photographic elements are illustrated at the end of the Examples.

The elements were exposed for 1/500 second by means of a 3000K Tungsten light source through a 0–3 neutral density step tablet, a heat-absorbing filter, and a filter designed to represent a motion picture color negative film. After exposure, the elements were processed through Process ECP-2B with the exception that those steps specific to sound track development were omitted. The process consisted of a prebath (10"), water rinse (20"), color developer (3'), stop bath (40"), first wash (40"), first fix (40"), second wash (40"), bleach (1'), third wash (40"), second fix (40"), fourth wash (1'), final rinse (10"), and then drying with hot air.

The ECP-2B Prebath consists of

| | |
|---|---|
| Water | 800 mL |
| Borax (decahydrate) | 20.0 g |
| Sodium sulfate (anhydrous) | 100.0 g |
| Sodium hydroxide | 1.0 g |
| Water to inake 1 liter | |
| pH @ 26.7° C. is 9.25 +/− 0.10 | |

The ECP-2B Color Developer consists of

| | |
|---|---|
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sbdium bromide (anhydrous) | 1.72 g |
| Sodium carbonate (anhydrous) | 17.1 g |
| Kodak Color Developing Agent, CD-2 | 2.95 g |
| Sulfuric acid (7.0 N) | 0.62 mL |
| Water to make 1 liter | |
| pH @ 26.7° C. is 10.53 +/− 0.05 | |

The ECP-2B Stop Bath consists of

| | |
|---|---|
| Water | 900 mL |
| Sulfuric acid (7.0 N) | 50 mL |
| Water to make 1 liter | |
| pH @ 26.7° C. is 0.90 | |

The ECP-2B Fixer consists of

| | |
|---|---|
| Water | 800 mL |
| Ammonium thiosulfate (58.0% solution) | 100.0 mL |
| Sodium bisulfite (anhydrous) | 13.0 g |
| Water to make 1 liter | |
| pH @ 26.7° C. is 5.00 +/− 0.15 | |

The ECP-2B Ferricyanide Bleach consists of

| | |
|---|---|
| Water | 900 mL |
| Fotassium ferricyanide | 30.0 g |
| Sodium bromide (anhydrous) | 17.0 g |
| Water to make 1 liter | |
| pH @ 26.7° C. is 6.50 +/− 0.05 | |

The Final Rinse solution consists of

| | |
|---|---|
| Water | 900 mL |
| Kodak Photo-Flo 200 ™ Solution | 3.0 mL |
| Water to make 1 liter | |

Processing of the exposed elements is done with the color developing solution adjusted to 36.7° C. The stopping, fixing, bleaching, washing, and final rinsing solution temperatures are adjusted to 26.7° C.

The optical density due to dye formation was then measured on a densitometer using filters in the densitometer appropriate to the intended use of the photographic element. Dye Density was then graphed vs. log(exposure) to form the Red, Green, and Blue D-LogE characteristic curves of the photographic elements. The Red minimum density (D-min) values for the elements A–G are shown in Table I.

TABLE I

| Element | Dye | Aryl group substituents at processing pH | Substituent π value* | D-min (Red) |
|---|---|---|---|---|
| A | A-1 | $OCH_3$ | −0.02 | 0.136 |
| B | A-2 | H | 0.0 | 0.149 |
| C | I-1 | $O^-$ (OH) | −3.87 (−0.67) | 0.074 |
| D | I-2 | $CONH_2$ | −1.49 | 0.069 |
| E | I-3 | $CO_2^-$ (COOH) | −4.36 (−0.32) | 0.069 |
| F | I-4 | Cl, Cl, $O^-$ | Σπ = −2.45 | 0.088 |
| G | no dye | | | 0.054 |

*π values from Substituent Constants For Correlation Analysis In Chemistry And Biology, Hansch and Leo, 1979.

The above results clearly show that the photographic elements containing dyes I-1 through I-4 in accordance with the invention show significantly lower Red D-min in the processed elements described above than elements containing the comparative dyes. The lower stain may be attributed to a lower level of interaction between the inventive dyes and the magenta coupler contained in the elements A–F than that exhibited between the comparative dyes and the magenta coupler. The table summarizes the substituents present on several of the inventive and comparative dyes and their published π values. It is clear from the data in the above table that low Red D-min is related to negative π values for the aromatic dye substituents. The degree of ionization for the COOH and OH substituents of the inventive dyes will determine an average π value for such ionizable dye substituents. Both ionized and non-ionized π values are indicated.

EXAMPLE 2

In a manner similar to that described for milling filter dye A-1 in Example 1, a dye dispersion (dispersion G) of filter dye II-1 was prepared except that the surfactant Triton™ X-200 was replaced by the dispersant Ketjenlube™ 522 (25% by weight of dye) and the surfactant Dowfax™ 2A1 (5% by weight of dye) to yield a 15.5% dye dispersion. This dye dispersion was combined with dye dispersion C (from Example 1) containing filter dye I-1, deionized gelatin, water, and spreading aids, and then coated on a transparent gelatin subbed polyethylene terephthalate support (with an antistat on the side opposite the emulsion side) in a magenta monochrome format with the following structure (element H):

Element H

Protective Overcoat Layer
- Poly(dimethyl siloxane), 200-CS 65.9 mg/m²
- Poly(methyl methacrylate) beads, 5.0 mg/m²
- Soluble green filter dye 1, 32.3 mg/m²
- Soluble green filter dye 2, 32.3 mg/m²
- Gelatin, 977.4 mg/m²
- Spreading aids
- Gelatin hardener Green Sensitized Layer
- AgClBr cubic grain emulsion, 25% Br, 0.15 micron, sensitized with green dye cpd 1, 0.5273 mmole/Ag mole, supersensitizer cpd 2, 1.1212 mmole/Ag mole, 470.4 mg/m²
- AgClBr cubic grain emulsion, 25% Br, 0.24 micron, sensitized with green dye cpd 1, 0.4785 mmole/Ag mole, supersensitizer cpd 2, 1.3902 mmole/Ag mole, 40.9 mg/m²
- Magenta dye forming coupler (M-1), 678.1 mg/m²
- Oxidized developer scavenger, cpd 3, 53.8 mg/m²
- Gelatin, 1916 mg/m²
- Spreading aids Antihalation Layer
- Filter dye I-1, 21.5 mg/m²
- Filter dye II-1, 53.8 mg/m²
- Deionized gelatin, 1076 mg/m²
- Spreading aids Support
- Transparent polyethylene terephthalate support with an antistat on side opposite emulsion side In a similar manner, elements I-L were prepared which were identical to element H except that the filter dyes and laydowns used in the antihalation layer were changed as described in Table II below.

A safelight sensitivity test was performed with elements H-L in the following manner. The elements were exposed for a period of 60 minutes by means of a 3000K, 1000 W Tungsten EGR light source through a Kodak Safelight Filter No. 8. (illuminance level was 15,000 lux without safelight filter) and a 0–3 neutral density step tablet. The elements were then processed and the optical density was measured as described in Example 1. The safelight speed of the elements was calculated by the following equation:

$$\text{safelight speed}=100(3-\log E)$$

where E represents the exposure value in lux-sec needed to obtain a 1.0 optical density. Based on this equation, it is readily understood that elements with more negative safelight speed values and/or lower maximum density (D-max) values are less sensitive to safelight exposure than elements with less negative safelight speeds and/or higher D-max values. The safelight speeds and D-max values for elements H–L from the safelight sensitivity test are shown in Table II.

TABLE II

| Element | Dye | Dye Laydown (mg/m²) | Safelight Green Speed | Safelight Green D-max |
|---|---|---|---|---|
| H | I-1 | 21.5 | −33.7 | 3.123 |
| | II-1 | 53.8 | | |
| I | I-1 | 21.5 | −105.2 | 2.043 |
| | II-1 | 150.7 | | |
| J | A-1 (Control) | 75.3 | −20.7 | 3.125 |
| K | A-1 (Control) | 172.2 | −75.6 | 2.333 |
| L | no dye | — | 26.5 | 3.203 |

Results from Table II show that element H containing filter dyes I-1 and II-1 is less sensitive to safelight exposure than element J containing the control filter dye A-1 although the total dye laydown in elements H and J are the same. Likewise, the results also show that element I containing filter dyes I-1 and II-1 at a higher laydown than in element H is less sensitive to safelight exposure than element K containing the control filter dye A-1 although the total dye laydown in elements I and K are the same.

EXAMPLE 3

Five cyan monochromes (elements M–Q) were prepared in a manner similar to the five magenta monochromes described in Example 2. The coating structure of element M containing the filter dye dispersions I-1 and II-1 in the antihalation layer is shown below. Elements N–Q differed from element M only in the composition and/or coverage of the antihalation layer dyes as indicated in Table III below.

Element M

Protective Overcoat Layer

- Poly(dimethyl siloxane), 200-CS 65.9 mg/m²
- Poly(methyl methacrylate) beads, 5.0 mg/m²
- Soluble red filter dye 3, 110.9 mg/m²
- Gelatin, 977.4 mg/m²
- Spreading aids
- Gelatin hardener Red Sensitized Layer

- AgClBr cubic grain emulsion, 25% Br, 0.15 micron, sensitized with red dye cpd 4, 0.1808 mmole/Ag mole, sensitizer cpd 2, 0.6327 mmole/Ag mole, 397.2 mg/m²
- AgClBr cubic grain emulsion, 25% Br, 0.24 micron, sensitized with red dye cpd 4, 0.1356 mmole/Ag mole, supersensitizer cpd 2, 0.7444 mmole/Ag mole, 44.1 mg/m²
- Cyan dye forming coupler (C-1), 968.8 mg/m².
- Oxidized developer scavenger, cpd 3, 12.9 mg/m². Gelatin, 3412 mg/m²
- Spreading aids Antihalation Layer

- Filter dye I-1, 21.5 mg/m²
- Filter dye II-1, 53.8 mg/m²
- Deionized gelatin, 1076 mg/m²
- Spreading aids Support

- Transparent polyethylene terephthalate support with an antistat on side opposite emulsion side Elements M–Q were exposed, processed, and the optical density was measured as described in Example 1. The D-max, fixed upper scale contrast (FUSC), and relative speed at a density of 1.0 (SPD1.0) values are listed in Table III. FUSC is defined as the slope of a line drawn between a point at a density of 1.0 and a point at 0.5 logE higher exposure. The relative speeds at a density of 1.0 were determined by interpolation over a 300 unit range corresponding to the exposure range generated by exposure through the 0–3 neutral density step tablet, where the relative speed at the end of the log(exposure) scale representing greatest exposure is assigned a value of 0 and the relative speed at the opposite end of the log(exposure) scale representing least exposure is assigned a value of 300.

TABLE III

| Element | Dye | Dye Laydown (mg/m²) | D-max | FUSC | SPD1.0 |
|---|---|---|---|---|---|
| M | I-1 | 21.5 | 3.478 | 3.551 | 103.0 |
| | II-1 | 53.8 | | | |
| N | I-1 | 21.5 | 3.465 | 3.544 | 103.1 |
| | II-1 | 150.7 | | | |
| O (control) | A-1 | 75.3 | 3.333 | 3.310 | 97.9 |
| P (control) | A-1 | 172.2 | 3.220 | 3.161 | 93.8 |
| Q (no dye) | — | — | 3.497 | 3.629 | 109.5 |

Results from Table III show that the combination of filter dyes I-1 and II-1 in elements M and N have an advantage over control filter dye A-1 alone in elements O and P in that they reduce D-max, upper scale contrast, and relative speed for a red sensitized emulsion layer to a lesser extent than the comparison dye.

EXAMPLE 4

Samples of the five magenta monochromes (elements H–L) and the five cyan monochromes (elements M–Q) were prepared as described in Example 2 and Example 3, respectively.

To evaluate halation latitude sensitivity, the elements were exposed for 32 seconds through the emulsion side by means of a 3200K tungsten light source with a 0.0 to 2.0 neutral density step tablet. The tablet is composed of two sections, the AIM and the HALATION LINE. The AIM is the area on the step chart that provides the characteristic D logE exposure. The HALATION LINE is a thin (4 mm), longitudinal line located in the center of the tablet; in this area of the element, direct exposure is completely eliminated, and only indirect halation exposure occurs.

The elements were then processed essentially as described in Example 1, except a 20" accelerator and a 40" persulfate bleach were substituted for the 1' ferricyanide bleach in accordance with an alternative ECP-2B process as described in Kodak Publication No. H-24 referenced above.

The elements were read on the emulsion side using two densitometry instruments. To obtain the characteristic D logE curve corresponding to normal exposure through the AIM section of the step tablet, the elements were read using a densitometer to locate the step that had a density of approximately 0.1 above D-min. This step and two steps above and below were densitometered. To obtain the halation D logE curve corresponding to the halation exposure, the areas on the elements in the HALATION LINE that were adjacent to the 5 AIM steps are read using a microdensitometer.

The halation curve was compared with the normally exposed D logE curve by measuring the logE difference of the two curves at a density of 0.10 above D-min. The logE difference, called Halation Latitude, is summarized in Table IV.

TABLE IV

| Element | Dye | Dye Laydown (mg/m²) | Red Halation Latitude | Green Halation Latitude |
|---|---|---|---|---|
| H | I-1 | 21.5 | — | 1.85 |
| | II-1 | 53.8 | | |
| I | I-1 | 21.5 | — | 2.47 |
| | II-1 | 150.7 | | |
| J | A-1 | 75.3 | — | 1.71 |
| K | A-1 | 172.2 | — | 2.20 |
| L | No Dye | — | — | 1.06 |
| M | I-1 | 21.5 | >1.80 | — |
| | II-1 | 53.8 | | |
| N | I-1 | 21.5 | >1.80 | — |
| | II-1 | 150.7 | | |
| O | A-1 | 75.3 | >1.80 | — |
| P | A-1 | 172.2 | >1.80 | — |
| Q | No Dye | — | 1.13 | — |

Halation Latitudes above 1.8 generally provide essentially equivalent halation protection for practical applications. The above data thus demonstrate that the dyes of the invention provide practical halation protection which is equivalent to or better than that of the comparative dyes.

EXAMPLE 5

A multilayer element was prepared using a coating melt prepared as follows. A solid particle dispersion of yellow filter dye cpd 5 was made by milling with Igepon™ T-77 (7% by weight of dye) (Rhone-Poulanc) in a manner similar to that described in Example 1. A solid particle dispersion of invention filter dye I-1 was also prepared in a manner similar to that described in Example 1. A solid particle dispersion of invention filter dye II-1 was also made in a manner similar to that described in Example 2. The three dispersions described above were added to a mixture of deionized gelatin, polystyrene sulfonic acid sodium salt (a thickener) and spreading aids, and then coated on a transparent support in a multilayer structure (element R). The support was a polyethylene terephthalate base which was subbed on both sides. An aqueous antistatic layer comprising vanadium pentoxide silver-doped at 8%, a terpolymer latex of acrylonitrile, vinylidene chloride, and acrylic acid, and coating aids was applied to the side opposite the emulsion side. On top of the antistatic layer was applied an overcoat comprising Witcobond™ W232 (Witco) polyurethane, Neocryl™ CX-100 crosslinker (Zeneca), (poly)methyl methacrylate beads, and coating aids.

Element R

Protective Overcoat Layer

Poly(dimethyl siloxane) 200-CS, 65.9 mg/m².

Poly(methyl methacrylate) beads, 5.3 mg/m².

Gelatin, 976.3 g/m².

Spreading aids.

Green Sensitized Layer

AgClBr cubic grain emulsion, 25% Br, 0.15 micron, spectrally sensitized with green dye cpd 1, 0.5273 mmole/Ag mole, supersensitizer cpd 2, 1.1212 mmole/Ag mole, 312.2 mg/m².

AgClBr cubic grain emulsion, 25% Br, 0.15 micron, spectrally sensitized with green dye cpd 1, 0.5273 mmole/Ag mole, supersensitizer cpd 2, 1.1770 mmole/Ag mole, 121.6 mg/m².

AgClBr cubic grain emulsion, 25% Br, 0.24 micron, spectrally sensitized with green dye cpd 1, 0.4785 mmole/Ag mole, supersensitizer cpd 2, 1.3902 mmole/Ag mole, 39.8 mg/m².

Magenta dye forming coupler (M-1), 699.7 mg/m².

Oxidized developer scavenger, cpd 3, 56.5 mg/m².

Soluble green filter dye 1, 40.0 mg/m².

Soluble green filter dye 2, 58.6 mg/m².

Gelatin, 2077 mg/m².

Interlayer

Oxidized developer scavenger, cpd 3, 79.1 mg/m².

Gelatin, 610.3 mg/m².

Spreading aids.

Red Sensitized Layer

AgClBr cubic grain emulsion, 25% Br, 0.15 micron, spectrally sensitized with red dye cpd 4, 0.1808 mmole/Ag mole, supersensitizer cpd 2, 0.6327 mmole/Ag mole, 398.3 mg/m².

AgClBr cubic grain emulsion, 25% Br, 0.24 micron, spectrally sensitized with red dye cpd 4, 0.1356 mmole/Ag mole, supersensitizer cpd 2, 0.7444 mmole/Ag mole, 32.3 mg/m².

Cyan dye forming coupler (C-1), 968.8 mg/m².

Oxidized developer scavenger, cpd 3, 26.0 mg/m².

Soluble red filter dye 3, 120.8 mg/m².

Palladium compound, cpd 6, 8.0 mg/m².

Gelatin, 3453 mg/m².

Gelatin hardener.

Interlayer

Oxidized developer scavenger, cpd 3, 79.1 mg/m².

Gelatin, 610.3 mg/m².

Spreading aids.

Blue Sensitized Layer

AgCl cubic grain emulsion, 0.58 micron, spectrally sensitized with blue dye cpd 7, 0.3336 mmole/Ag mole, 671.7 mg/m².

AgCl cubic grain emulsion, 0.76 micron, spectrally sensitized with blue dye cpd 7, 0.2669 mmole/Ag mole, 223.9 mg/m².

Yellow dye forming coupler (Y-1), 1883.7 mg/m².

Yellow dye cpd 8, 22.0 mg/m².

Soluble blue filter dye 4, 32.6 mg/m².

Sequestrant cpd 9, 322.9 mg/m².

Sequestrant cpd 10, 35.5 mg/m².

Ultraviolet absorber cpd 11, 322.9 mg/m².

Gelatin, 3980 mg/m².

Antihalation Layer

Yellow dye cpd 5, 32.3 mg/².

Filter dye I-1, 53.8 mg/m².

Filter dye II-1 , 107.6 mg/m².

Polystyrene sulfonic acid sodium salt, 12.9 mg/m².

Deionized gelatin, 758.9 mg/m².

Spreading aids.

Support 4.0 micron polyethylene terephthalate base subbed with a terpolymer latex of methyl acrylate, vinylidene chloride and itaconic acid, coated with an antistat layer comprising 4.3 mg/m$^2$ vanadium pentoxide silver-doped at 8%, 4.3 mg/m$^2$ of a terpolymer latex of acrylonitrile, vinylidene chloride, and acrylic acid, and 3.2 mg/m$^2$ of coating aid Triton™ X100, and overcoated with a barrier layer comprising 1233 mg/m$^2$ of Witcobond™ W232, 74.0 mg/m$^2$ of Neocryl™ CX-100 crosslinker, 26.9 mg/m$^2$ of (poly)methyl methacrylate beads, 39.5 mg/m$^2$ of Triton™ X100, and 1.1 mg/m$^2$ of Michemlube-160™.

Element R was exposed and processed as described in Example 1. The optical density was measured, and the stain level was judged to be quite suitable for the intended use of such an element in the photographic industry.

The following structures represent compounds utilized in the above photographic elements.

green sensitizing dye cpd 1

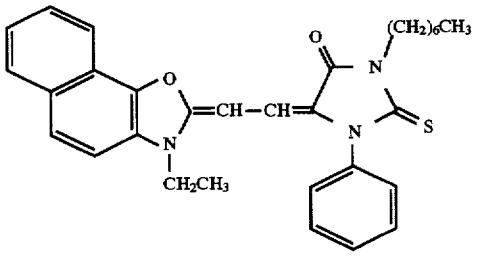

supersensitizer cpd 2

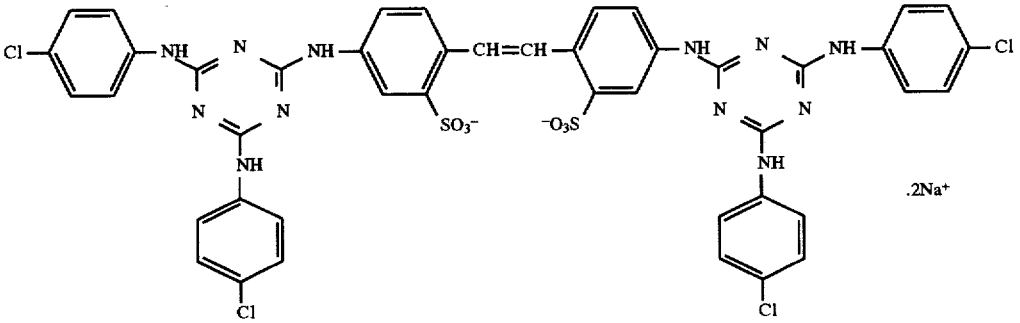

magenta coupler M-1

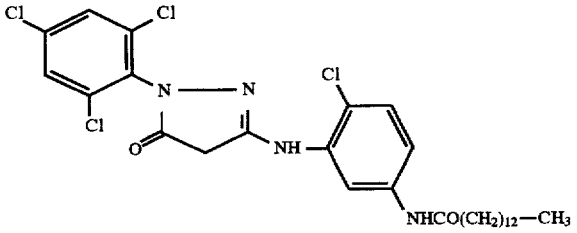

scavenger cpd 3

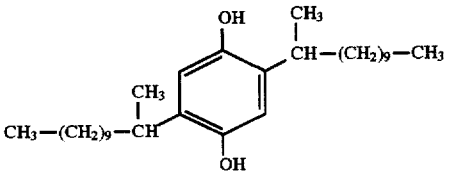

soluble green filter dye #1

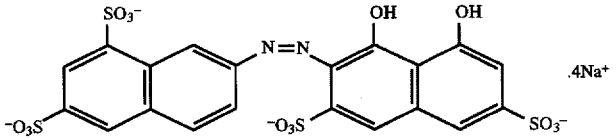

-continued
soluble green filter dye #2
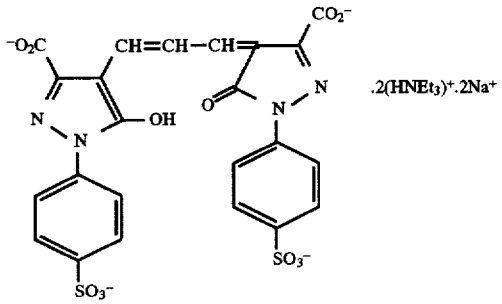
red sensitizing dye cpd 4
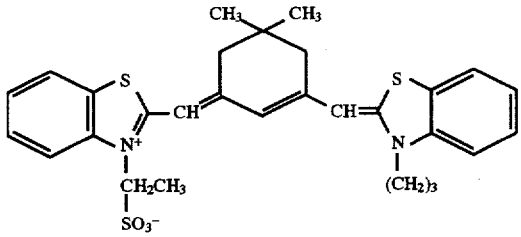
cyan coupler C-1
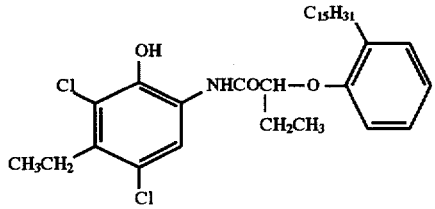
soluble red filter dye #3
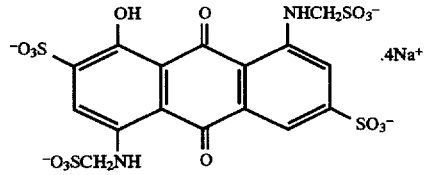
yellow filter dye cpd 5
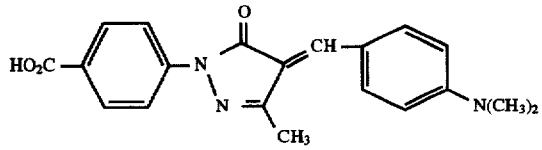
palladium cpd 6
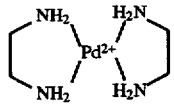
blue sensitizing dye cpd 7
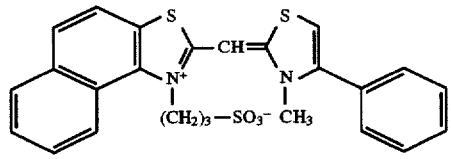

-continued
yellow coupler Y-1
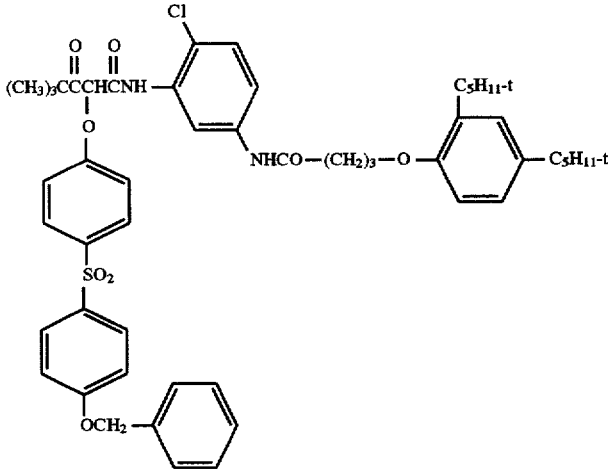
yellow dye cpd 8
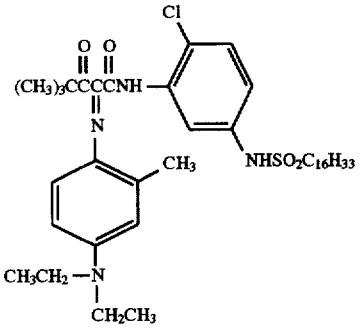
soluble blue filter dye 4
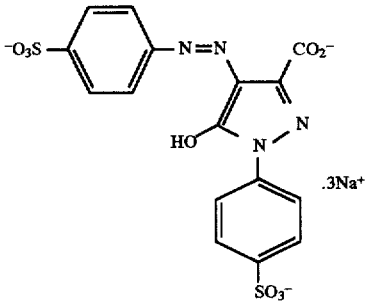
sequestrant cpd 9
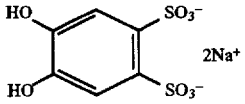
sequestrant cpd 10
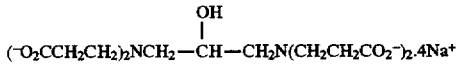
Ultraviolet absorber cpd 11
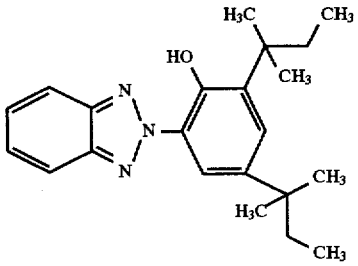
This invention has been described in detail with particular reference to preferred embodiments thereof. It will be understood that variations and modifications can be made within the spirit and scope of the invention.

We claim:

1. A silver halide light sensitive photographic element comprising a support bearing on one side thereof at least one blue-sensitive silver halide emulsion yellow-image forming layer, at least one red-sensitive silver halide emulsion cyan-image forming layer, at least one green-sensitive silver halide emulsion magenta-image forming layer, and an antihalation layer comprising a cyan filter dye coated between the support and the red-sensitive layer; wherein the green-sensitive layer comprises a four-equivalent magenta image forming coupler and the cyan filter dye is of the formula

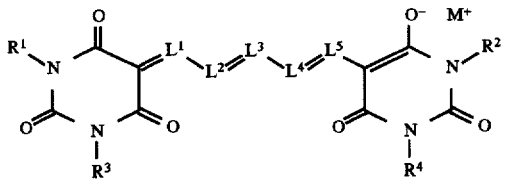

where $L^1$, $L^2$, $L^3$, $L^4$ and $L^5$ are methine groups;

$R^1$, $R^2$, $R^3$ and $R^4$ are independently H or alkyl or aryl groups; and $M^+$ is H or a counter ion;

wherein at least one of $R^1$, $R^2$, $R^3$ and $R^4$ comprises an aryl group substituted with a substituent having a $\pi$ value of less than −0.10, where $\pi$ represents the group substituent component of the hydrophobicity parameter logP.

2. A photographic element according to claim 1, wherein $R^3$ and $R^4$ are H, and $R^1$ and $R^2$ are each phenyl groups substituted with one or more substituents, where the sum of the $\pi$ values for the substituents on each of the $R^1$ and $R^2$ phenyl groups is less than −0.10 at pH above 8.

3. A photographic element according to claim 2, wherein the substituent having a $\pi$ value of less than −0.10 is an ionizable group having a pKa between 2–10.

4. A photographic element according to claim 2, wherein the substituent having a $\pi$ value of less than −0.10 is a carboxyl, a sulfonamido, a sulfamoyl, a sulfonylcarbamoyl, a carbonylsulfamoyl, a hydroxy, an amide, an acetyl, a cyano, or a sulfonamide group.

5. A photographic element according to claim 1, wherein the substituent having a $\pi$ value of less than −0.10 is an ionizable group having a pKa between 2–10.

6. A photographic element according to claim 1, wherein the substituent having a $\pi$ value of less than −0.10 is a carboxyl, a sulfonamido, a sulfamoyl, a sulfonylcarbamoyl, a carbonylsulfamoyl, a hydroxy, an amide, an acetyl, a cyano, or a sulfonamide group.

7. A photographic element according to claim 1, wherein $M^+$ is H, Na, K, pyridinium, triethylammonium, or ammonium.

8. A photographic element according to claim 1, wherein a blue-light absorbing filter dye is coated between the support and the blue-sensitive layer.

9. A photographic element according to claim 8, wherein the blue-light absorbing filter dye is a merostyryl, monomethine oxonol or arylidene filter dye.

10. A photographic element according to claim 8, wherein a tricyanopropene filter dye of the formula (II) is coated between the support and the red-sensitive layer:

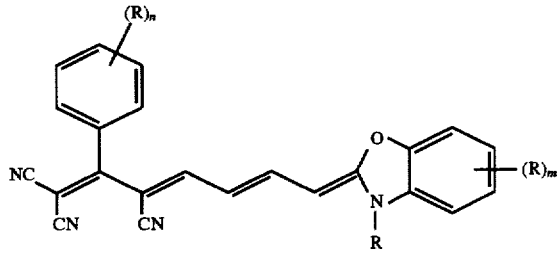

(II)

wherein each R represents H or a substituent, n represents 0–5, and m represents 0–4.

11. A photographic element according to claim 10, wherein each R independently represents halogen, cyano, hydroxy, or an alkyl, aryl, alkoxy, aryloxy, amino, alkoxycarbonyl, amido, acyl, alkylamino, carboxy, sulfonamido, or sulfamoyl group.

12. A photographic element according to claim 10, wherein the blue-light absorbing filter dye, the tricyanopropene filter dye and the cyan filter dye are coated in the same antihalation layer.

13. A photographic element according to claim 12, wherein the antihalation layer comprises a hydrophilic colloid layer containing solid particle dye dispersions of the blue-light absorbing filter dye, the tricyanopropene filter dye and the cyan filter dye, wherein said dyes are readily soluble and removed or decolorized upon photographic processing at pH above 8.

14. A photographic element according to claim 10, wherein the blue-light absorbing filter dye comprises a merostyryl, monomethine oxonol and/or arylidene filter dye present at a combined coverage of from about 10–500 $mg/m^2$, the dye of formula I is present at a coverage from about 10–500 $mg/m^2$, and the dye of formula II is present at a coverage from about 10 to 500 $mg/m^2$.

15. A photographic element according to claim 14, wherein the blue-light absorbing filter dye is present at a combined coverage of from 25–100 $mg/m^2$, the dye of formula I is present at a coverage from 25–100 $mg/m^2$, and the dye of formula II is present at a coverage from 50–200 $mg/m^2$.

16. A photographic element according to claim 1, wherein the antihalation layer comprises a hydrophilic colloid layer containing solid particle dye dispersions of the cyan filter dye, wherein said dye is readily soluble and removed or decolorized upon photographic processing at pH above 8.

17. A photographic element according to claim 1, further comprising an antistatic layer on the opposite side of a support relative to the silver halide image forming layers.

18. A photographic element according to claim 17, wherein the antistatic layer is a transparent, photographic process-surviving antistatic layer.

19. A photographic element according to claim 18, wherein the antistatic layer comprises conductive fine particles of crystalline metal oxides dispersed in a polymeric binder.

20. A photographic element according to claim 19, further comprising a protective polymeric overcoat layer coated over the antistatic layer.

* * * * *